US007930959B1

(12) United States Patent
Greene

(10) Patent No.: US 7,930,959 B1
(45) Date of Patent: Apr. 26, 2011

(54) TABLE SAW ACCESSORY

(76) Inventor: Larry Greene, Scottsdale, AZ (US)

( * ) Notice: Subject to any disclaimer, the term of this patent is extended or adjusted under 35 U.S.C. 154(b) by 1075 days.

(21) Appl. No.: 11/434,991

(22) Filed: May 15, 2006

Related U.S. Application Data

(60) Provisional application No. 60/682,554, filed on May 18, 2005.

(51) Int. Cl.
*B26D 7/06* (2006.01)

(52) U.S. Cl. ..... 83/418; 83/441.1; 83/425; 83/446; 83/477.2

(58) Field of Classification Search ..... 83/827, 83/820, 438, 444, 444.1, 446, 441.1, 418, 83/419, 420, 421, 441, 425, 401, 442, 477.2
See application file for complete search history.

(56) References Cited

U.S. PATENT DOCUMENTS

| | | | | | |
|---|---|---|---|---|---|
| 2,627,657 | A | * | 2/1953 | Etchen | 30/264 |
| 2,696,852 | A | * | 12/1954 | Dunton | 144/250.18 |
| 2,806,493 | A | * | 9/1957 | Gaskell | 83/438 |
| 2,808,084 | A | * | 10/1957 | Eschenburg et al. | 83/438 |
| 3,556,424 | A | * | 1/1971 | Catallo et al. | 242/523.1 |
| 4,164,882 | A | * | 8/1979 | Mericle | 83/409 |
| 4,206,910 | A | * | 6/1980 | Biesemeyer | 269/236 |
| 4,432,263 | A | * | 2/1984 | Kowalchuk | 83/438 |
| 4,485,711 | A | * | 12/1984 | Schnell | 83/425 |
| 4,817,482 | A | * | 4/1989 | Dunaway et al. | 83/438 |
| 4,848,203 | A | * | 7/1989 | Brooks | 83/438 |
| 4,976,298 | A | * | 12/1990 | Gibson | 144/250.15 |
| 4,977,937 | A | * | 12/1990 | Hessenthaler | 144/241 |
| 5,058,474 | A | * | 10/1991 | Herrera | 83/447 |
| 5,123,464 | A | * | 6/1992 | Van Gelder | 144/247 |
| 5,228,374 | A | * | 7/1993 | Santeramo, Sr. | 83/438 |
| 5,390,538 | A | * | 2/1995 | Spath | 72/133 |
| 5,478,052 | A | * | 12/1995 | Rodrigues | 266/68 |
| 5,647,258 | A | * | 7/1997 | Brazell et al. | 83/438 |
| 5,740,711 | A | * | 4/1998 | Ramirez | 83/438 |
| 6,148,703 | A | * | 11/2000 | Ceroll et al. | 83/13 |
| 6,360,641 | B1 | * | 3/2002 | Talesky et al. | 83/438 |
| 6,443,266 | B2 | * | 9/2002 | Murakami et al. | 187/401 |
| 6,601,493 | B1 | * | 8/2003 | Crofutt | 83/438 |
| 6,854,371 | B2 | * | 2/2005 | Yu | 83/438 |
| 6,890,141 | B2 | * | 5/2005 | Freund et al. | 414/788.5 |
| 6,899,004 | B1 | * | 5/2005 | Miller | 83/446 |
| 7,140,286 | B2 | * | 11/2006 | Schwartz | 83/446 |

(Continued)

OTHER PUBLICATIONS

Delta #34-985; Parts replacement information downloaded from "http://www.mikestools.com/download/Delta-Parts-Lists/34-985-Stockfeeders-SF1A.pdf" on Sep. 15, 2009.*

(Continued)

*Primary Examiner* — Kenneth E. Peterson
*Assistant Examiner* — Sean Michalski
(74) *Attorney, Agent, or Firm* — Gregory J. Nelson

(57) ABSTRACT

A mounting system for a table saw accessory such as a power feed. A carrier is slidably mounted on a rail or flange at the rear of the saw table so that it may traverse the rear of the table. The rear of the saw fence is secured to the carrier. A mounting plate for the power feed is on either the carrier or the fence allowing the power feed to be moved between use and out-of-the-way positions. In the out-of-the-way position, the power feed allows the user to safely feed materials into the cutting blade area.

4 Claims, 5 Drawing Sheets

U.S. PATENT DOCUMENTS

| | | | | |
|---|---|---|---|---|
| 7,231,858 | B2 * | 6/2007 | Oberheim | 83/477.2 |
| 2001/0047908 | A1 * | 12/2001 | Murakami et al. | 187/266 |
| 2002/0078810 | A1 * | 6/2002 | Talesky et al. | 83/438 |
| 2002/0157515 | A1 * | 10/2002 | Dick | 83/438 |
| 2004/0231483 | A1 * | 11/2004 | Hewitt et al. | 83/446 |
| 2008/0257124 | A1 * | 10/2008 | Yu | 83/438 |

OTHER PUBLICATIONS

Delta Instruction Manual—Dated Aug. 20, 1988.

Delta Machinery—Portable Cable—Biesemeyer T-Square—Undated.

* cited by examiner

TABLE SAW ACCESSORY

CROSS REFERENCE TO RELATED APPLICATION

This is application is based on U.S. provisional patent application Ser. No. 60/682,554, filed May 18, 2005, of the same title.

FIELD OF THE INVENTION

The present invention relates to a table saw accessory and more particularly relates to a table saw fence system having provision for mounting a power or stock feeder.

BACKGROUND OF THE INVENTION

The table saw is one of the most commonly used stationary power tools in any woodworking shop. Table saws are used both by the home hobbyist as well as professional wood workers. The conventional table saw includes a housing having a motor which powers a rotary blade. The blade may be raised and lowered with respect to the working surface to vary the design of the cut.

Generally table saws are mounted on a fixed base or legs. Most table saws are equipped with a rip fence, miter gauge, blade guard, spreader and anti-kickback device. The rip fence is parallel to the line of the saw blade to prevent binding and minimize kickback. When using a table saw for various operations such as grooving, shaping or cutting narrow strips of stock, safe practice is to use a push block to keep the user's hands and fingers away from the saw blade. On the more expensive or professional models of table saws, fences such as the Biesemeyer T-square fences provide rugged, accurate and reliable fences which may be accurately adjusted relative to the blade adjusts the width of the cut. Material is maintained in firm engagement with the fence and advanced into the blade area.

The more sophisticated saws may include a power feed or a stock feeder which has rollers or belt surfaces which are powered and which will engage the work piece to advance the work piece through the blade cutting area. The use of a power feeder increases safety and also improves the accuracy of the cut as the stock will not tend to stray off the vertical surface of the fence.

Most current designs of stock feeders are mounted in a position on the table saw which may interfere with the operation and use of the saw and adjustment of the fence when the power feeder is not used. Accordingly there exists a need for a mobile power feed mounting system which can be used with virtually any commercial power or stock feeder and which will allow the fence to be used in a traditional manner while using a power feed without the fence interfering with a typical or traditional mounting to the top of the table saw.

BRIEF SUMMARY OF THE INVENTION

Briefly, the present invention provides a mounting system for power feeds and attaches to one end, usually the rear end, of a conventional saw fence. The system includes a carrier attachable to the fence. In one embodiment, one leg of the carrier has a plurality of slots which adjustably receive guide rollers which engage a projecting flange at the rear edge of the saw table. The guide flange or rail at the rear of the saw table smoothly allows the fence to be adjusted relative to the saw blade. The opposite or front edge of the fence is provided with guide and locking means as conventionally found on table fences such as the Biesemeyer type. The guide and locking mechanism at the front may include a guide channel and a traditional fence clamp.

A mounting bracket for the base of the power feed is secured either to the fence at a location near its distal end projecting in cantilever fashion from the fence or may be secured to a surface of the carrier. The mounting bracket is provided with holes which are adapted to align with the mounting holes in the base of the power feed or other accessory. The base of the power feed is secured to the mounting bracket by conventional fasteners such as bolts. Thus, the fence may be used in its traditional fashion while using the power feed without interference from the power feed which may be placed in an out-of-the-way position. The power feed is readily available when needed. The elongate carrier and roller assembly counters the torque forces from the power feed created when stock is fed through the cutting area of the saw.

BRIEF DESCRIPTION OF THE DRAWINGS

The above and other advantages and objects of the present invention will become more apparent from the following description, claims and drawings in which:

DETAILED DESCRIPTION OF THE DRAWINGS

Figure 7:
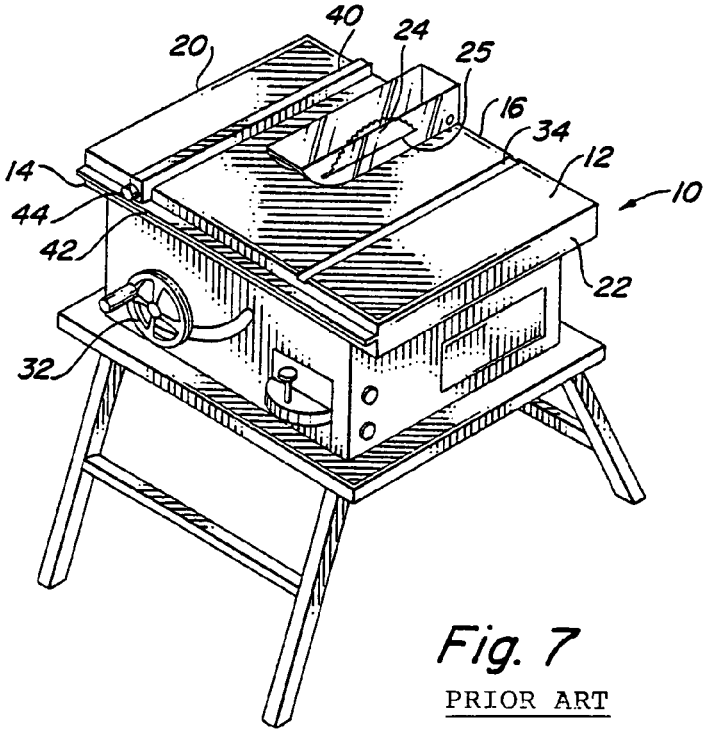
Fig. 7 PRIOR ART
FIG. 7 is a perspective view of a representative table saw.

Turning now to the drawings, a representative table saw is shown in FIG. 7 and generally designated by numeral 10 and includes a table surface 12 having a front edge 14, rear edge 16 and opposite side edges 20, 22. A slot 25 extends through the surface to receive a portion of the saw blade 24 which is powered by a motor within the saw housing. The blade is adjustable at a handwheel 32 as is conventional. A miter slot 34 extends between the front and rear edges of the saw. A fence 40 is provided and is adjustable along the surface of the table saw to vary the distance between a vertical surface of the fence and the saw blade 24. Generally, the fence 40 is constructed of aluminum or other material and has a rectangular cross section. One type of fence for professional use is the Biesemeyer T-square fence system. Fences of this type generally have a guide or track 42 along the front surface of the table which receives a guide depending from the front of the fence. A locking clamp 44 is provided so that once the user has established and set the desired distance between the vertical face of the fence and the saw blade the fence may be locked. The above is a general description of a representative table saw to assist in an understanding of the present invention.

The present invention provides a mounting system for a power feed securable to the rear of the fence. The present system is adaptable to most fences such as T-square. Biesemeyer-type fences, as well as other similar types of saw fences. Power feeds 50 of the type as manufactured by Maggi® are representative of the type of tools that may be secured to the fence according to the present invention.

Figure 1:
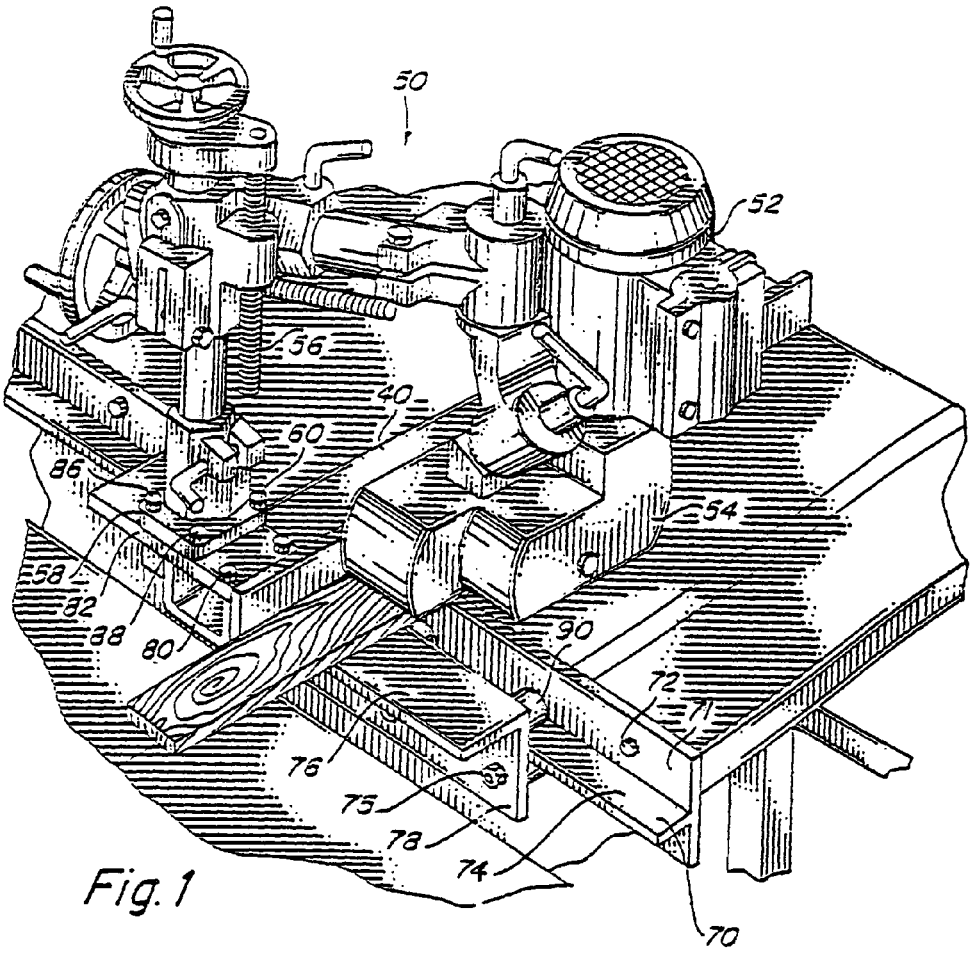
FIG. 1 is a perspective view of a representative table saw having a fence modified to include the power feed mounting system of the present invention mounted on the fence.

FIG. 1 shows a power feed 50 of this type and is intended to be a representation of various models and makes of power feeds. The typical power feed 50 has an electric motor 52 which drives a belt or plurality of rollers within the head 54 of the tool. The head may be selectively positioned by an adjustment mechanism such as various lead screws 56. Thus, adjustment of the vertical height of the head, rotational position and distance from the base can also be adjusted in accordance with the requirements of the application. The representative power feed device has a base 58 which is shown as being generally square with a plurality of spaced-apart mounting holes 60.

One embodiment of the mounting system of the present invention, as seen in FIG. 1. The saw includes a guide flanges or rails 70 which extends substantially the full width of the rear of the saw table disposed below the upper surface of the table. Guides 70 are provided on most table saws of professional quality and may be a flange, rail, rod or similar configuration. The guides 70 are shown as flanges having a vertical projecting leg 71 of an angle which is secured to the rear of the table by suitable fasteners such as bolts 72. The guide flange provides a horizontal surface 74 for receipt of the rear carrier 75.

Figure 4:
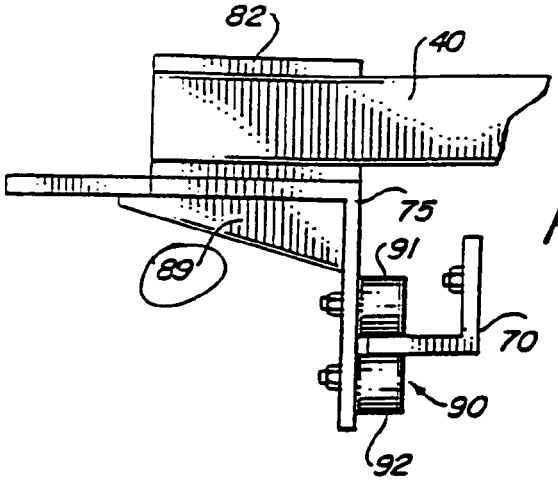
FIG. 4 is a side view of the embodiment of FIG. 1.

The rear carrier 75 is also shown as a section of angle having a horizontal leg 76 and a vertical leg 78. The distal or rear end of the fence 40 is secured to the horizontal surface of the rear carrier 75 at an intermediate location by vertically depending fasteners 80 or by welding. A mounting plate 82 which receives the base 58 of the power feed is supported on the upper surface of the fence and extends in cantilever fashion from the side of the fence. The carrier 75 may include a gusset 89 as seen in FIG. 4.

The power feed base 58 is secured to the flange by fasteners such as fasteners 86 which extend through the base and mounting plate. Longer fasteners 88 are provided which will depend through the base mounting plate to the underside of the fence. The carrier 75 traverses the flange 70 on a plurality of roller sets 90. Each roller set comprises a pair of rollers 91, 92 vertically spaced from one another and which oppositely engage the surfaces of the flange 70.

Figure 5:
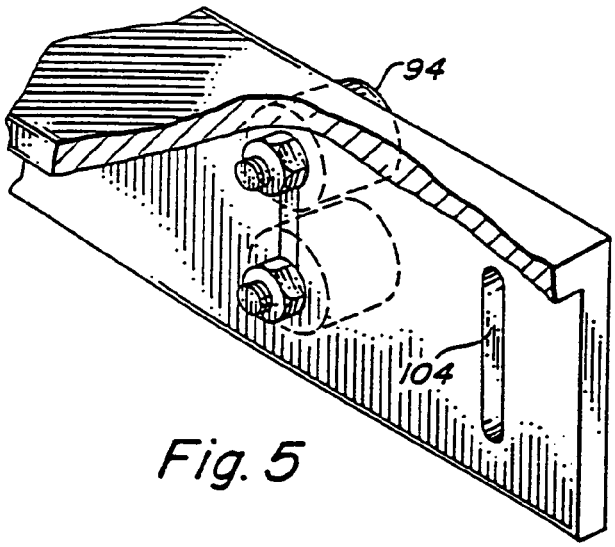
FIG. 5 is a perspective view illustrating the adjustable roller assemblies on the guide.
Figure 6:
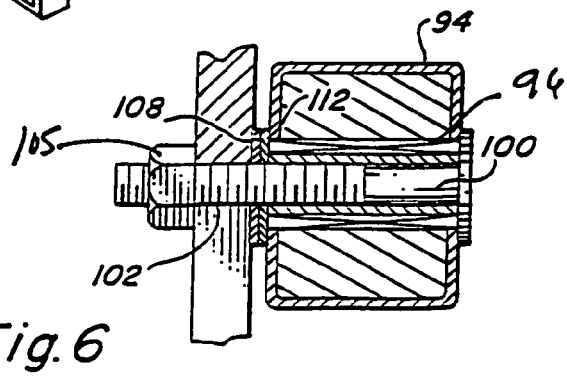
FIG. 6 is a cross-sectional view of a roller assembly.

As seen in FIGS. 5 and 6, the roller assemblies 90 each comprise a roller wheel 94 of a low friction material such as urethane having a central bore 96 which receives an axle member 100. The axle member is shown as a bolt having a head and elongated, threaded body 102. Spaced-apart slots 104 are provided in the support. The elongated, threaded body of the bolts extend through vertical slots 104 in the vertical leg of the bracket. Washers 108 are provided on either side of the roller and between the nut 105 and the support. A spacer 112 is interposed between the washers at the inner end of the roller and the vertical leg of the support. Thus, by loosening the nut, the position of the rollers can be precisely adjusted so that smooth and accurate movement of the guide 75 along flange 70 is achieved.

Figure 3:
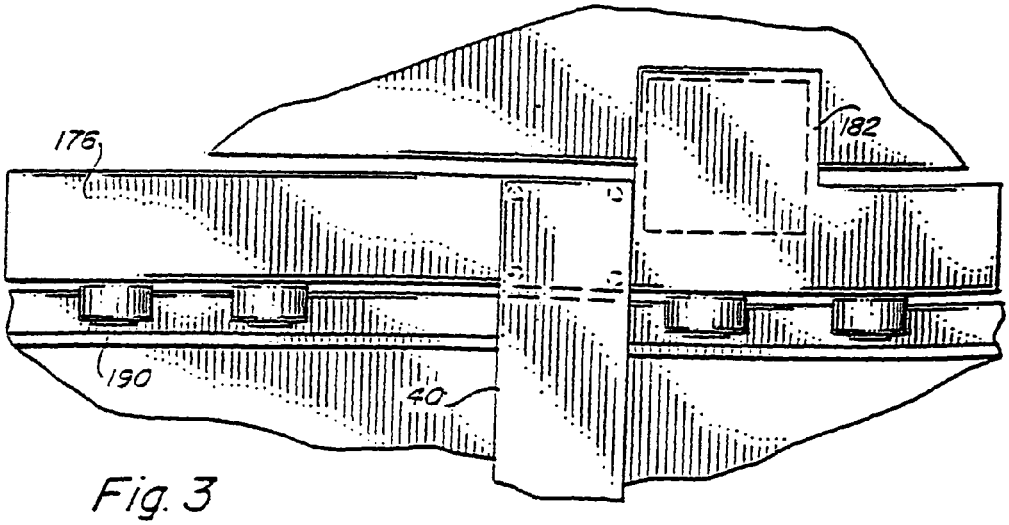
FIG. 3 is a top view of the distal end of the fence and the bracket as shown in FIG. 2.
Figure 2:
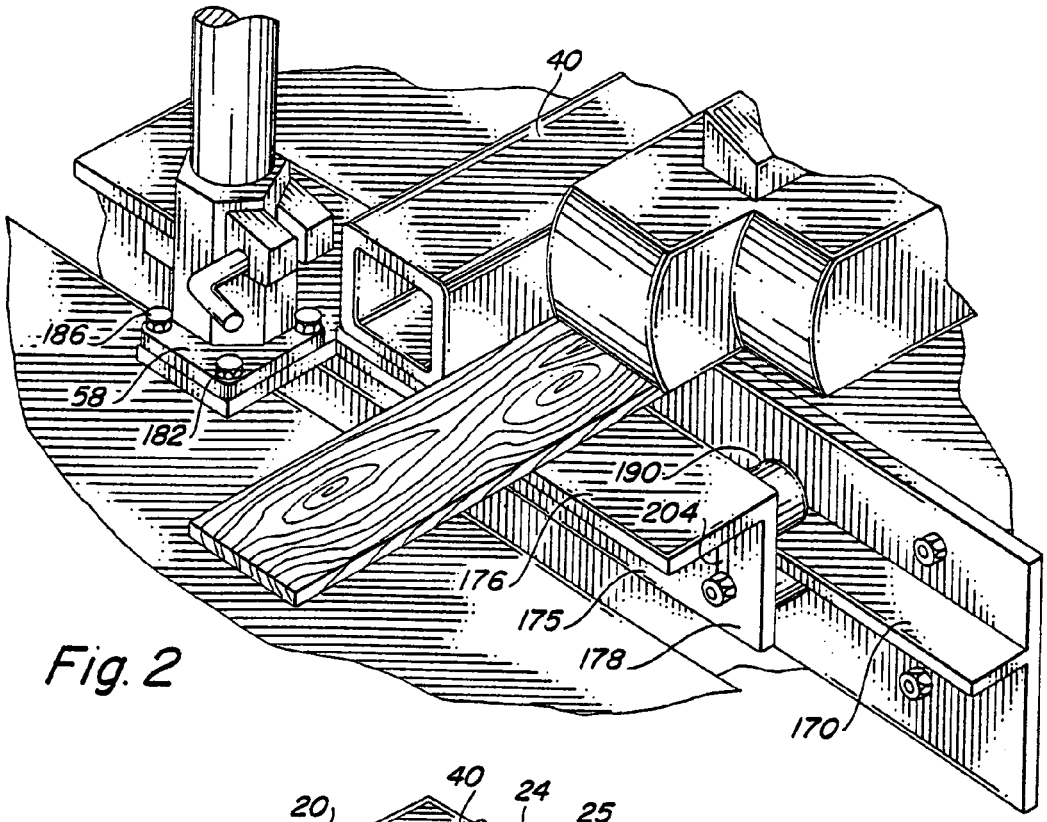
FIG. 2 is a perspective view of the distal end of the fence showing another embodiment of the mounting bracket and guide in which the bracket is located on the guide.

FIGS. 2 and 3 show an alternate carrier arrangement which also attaches to the rear or distal end of the saw fence either by conventional fasteners or by welding. The carrier 175 is an angle bracket having a horizontal leg 176 which is secured to the saw fence 40 and a vertically depending leg 178 which has a plurality of spaced-apart, vertical slots 204. The vertical slots 204 receive roller wheel pairs 190 as previously described. The rollers engage the opposite surface of a guide, rail or flange 170 horizontally disposed along the rear edge of the saw and bolted thereto. A mounting plate 182 for the accessory is secured to the horizontal leg 176 of the guide adjacent the saw fence. The mounting plate is shown as being generally rectangular having a configuration conforming to the baseplate 58 of the power feed. Fasteners 186 extend through the baseplate and fixed mounting plate. It will be apparent that the mounting plate 182 extends in cantilever fashion projecting rearwardly from the horizontal leg of the guide. The position of the rollers 190 can be adjusted so that the guide smoothly traverses along a guide flange at the rear of the saw.

Figure 9:
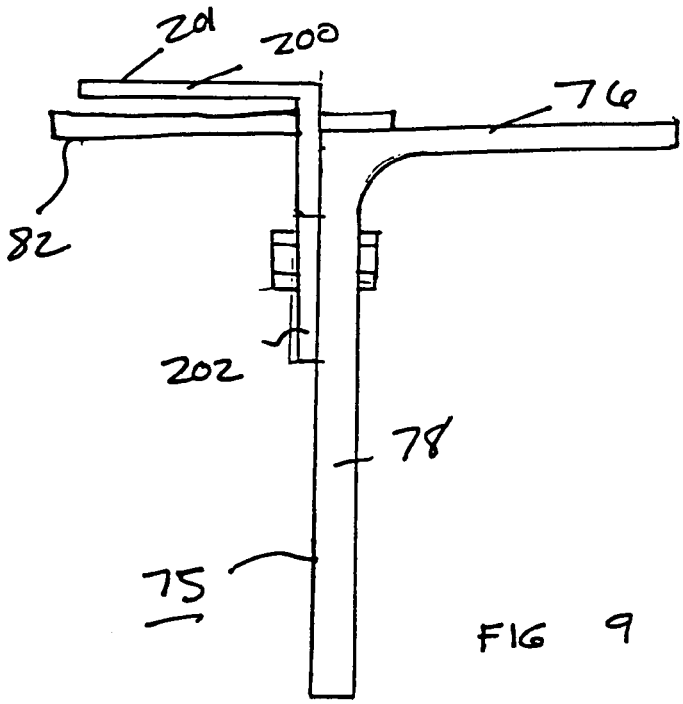
FIG. 9 is a sectional view taken along line 9-9 of FIG. 8.
Figure 8:
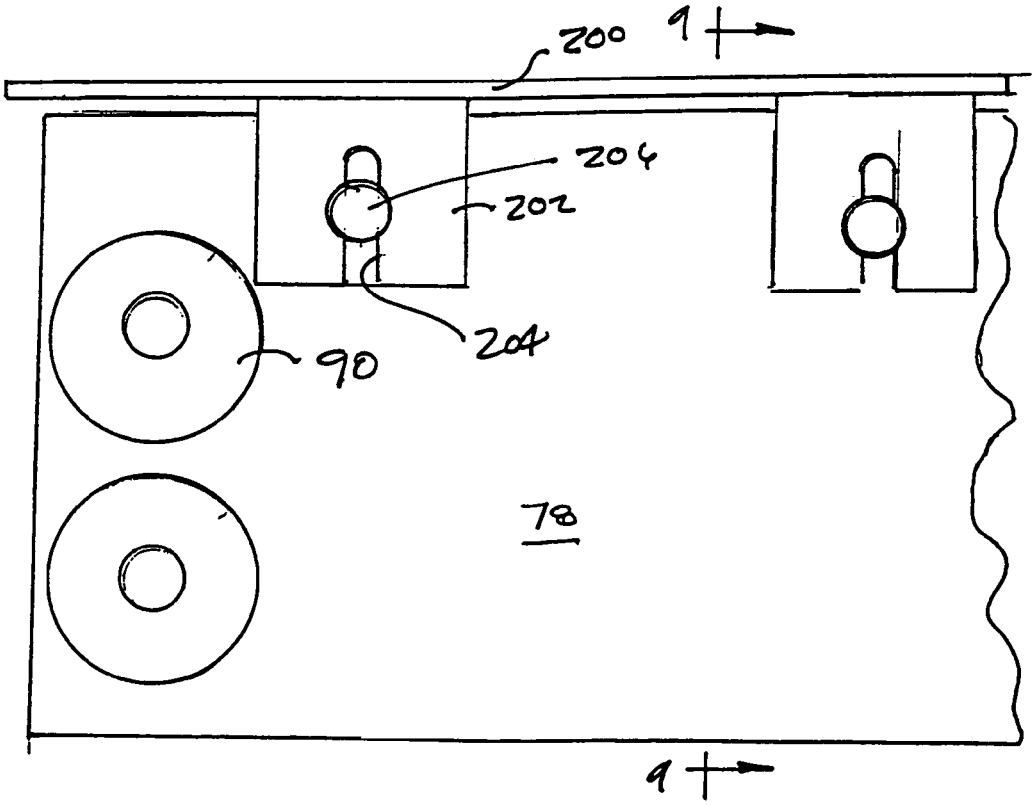
FIG. 8 is an end view f a modified rear guide.

FIGS. 8 and 9 show a modified version of the rear carrier again designated by the numeral 75. The rear carrier has a horizontal leg 76 and a vertical leg 78 and has a mounting plate 82 for a power feed or other accessory as described above.

The modification comprises the addition of a support 200 shown as an angle having a surface 201 extending forwardly from the carrier. The surface 201 provides a bridge which extends across the area between the vertical leg 78 and the rear of the saw table. This open area A is seen in FIG. 2. The bridge 200 is vertically adjustable. Tabs 202 define slots 204 which receive fasteners 206 which extend into the carrier 75. The support 200 will support a workpiece W against flexing due to the pressure applied by the rollers or belts located in the power feed head 54.

Figure 10:
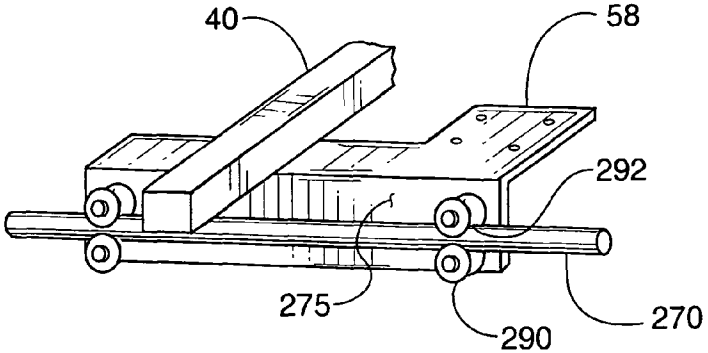
FIGS. 10 to 12 illustrate alternate embodiments of the rear guide.
Figure 11:
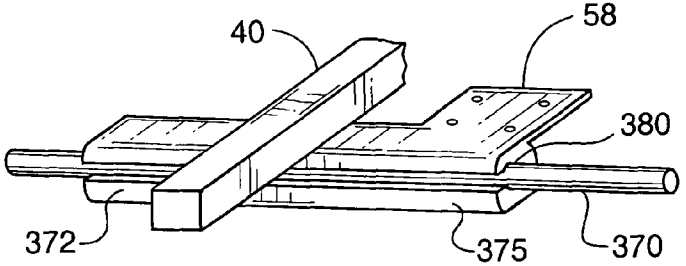
Figure 12:
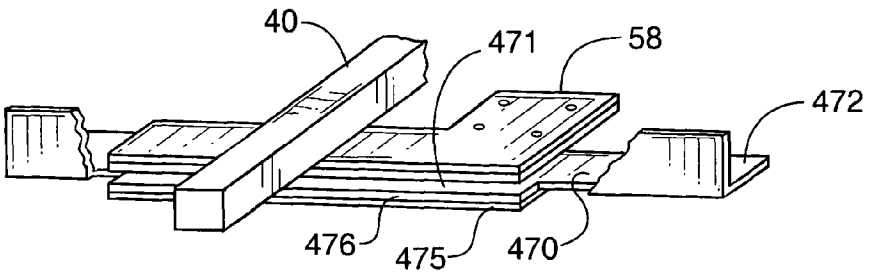

Other arrangements to accommodate translation of the rear guide relative to the table saw are shown in FIGS. 10, 11 and 12. In FIG. 10, the saw is provided with a guide rail 270. The rear guide 275 has spaced-apart pairs of rollers 290 each of which have a concave surface 292 which engages the rail 270. The guide is attachable to fence 40 and has a mounting surface 58 for a power feed or other accessory.

In FIG. 11, rail 370 on the saw is engaged by a sleeve 372 on the carrier 375. The sleeve incorporates a journal bearing 380 to reduce friction. The carrier 375 has a mounting plate 58 and is secured to the rear end of fence 40.

In FIG. 12, the saw has a rear guide flange 470 having a horizontal leg 472 which receives carrier 475. Carrier 475 has planar surfaces 476, 477 which engage leg 472 so the carrier may traverse the flange 470 at the rear of the saw table. The carrier is attached to the saw fence 40 and has a plate 58 for mounting a power feed.

The various embodiments of the mounting system described above will adapt to virtually any commercially available power stock feeder, as well as other saw accessories. The only variation that may be necessary is the position of the mounting holes in the mounting plate to conform to the location of the mounting holes in the baseplate of the stock feeder. The design is simple and will secure to a table saw fence such as the conventional T-square Biesemeyer-type fences allowing a power feed to be mounted so the fence can be used in its traditional fashion while using the power feed without interfering with the typical or traditional mounting to the table saw top as the power feed or accessory may be pivoted to an out-of-the-way position. The power feed is accessible and may be easily placed in a use-position as seen in FIG. 1. The system allows the user to feed materials into the saw such as narrow strips to wide sheets of plywood without the user having to use a push stick or positioning him- or herself in line with the saw blade. Other safety features include elimination or minimization of kickback and user fatigue from repetitive cuts. The user's hands are no longer in proximity of the saw blade and productivity is greatly increased. The user does not have to push stock through the saw blade and the user can position him- or herself on the side of the saw table. If the power feed is not required, the user can simply swing the power feed to an out-of-the-way position and use the saw fence in a conventional fashion. The roller mounting bracket moves the power feed with the fence side-to-side and there are no complicated or excessive movements.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. The combination of a mounting for a stock feeder having a base and a table saw comprising:

(a) a table saw having a generally planar table defined by a front edge and a rear edge, said table saw having a motorized blade extending through the table having a blade rotation direction toward the front edge of the table;

(b) a fence extending between the front and rear table edges and slidable relative to the saw blade;

(c) a fence guide having a guide surface extending across the rear table edge for guiding and positioning said fence relative to the saw blade;

(d) an elongate carrier attached to the fence having a vertical leg with spaced-apart rollers adjustably mounted on said vertical leg and engaging said guide surface to traverse said carrier along said guide surface, said carrier having a horizontal leg generally aligned with the table to support a work piece; and (e) a mounting plate extending rearwardly from the table, said plate secured to one of said fence or carrier, said plate defining a mounting surface for the base of the stock feeder in an accessible adjustable position at the rear of the table.

2. The combination of claim 1 wherein said mounting plate projects from the fence.

3. The combination of claim 1 wherein said mounting plate from the carrier adjacent the fence.

4. The combination of claim 1 wherein the carrier is vertically adjustable relative to said guide to align it with the table top.

* * * * *